United States Patent [19]

Tietsworth

[11] Patent Number: 4,628,909

[45] Date of Patent: Dec. 16, 1986

[54] ALTERNATIVE HEALTH CARE MACHINE

[76] Inventor: Alvin M. Tietsworth, 1606 Swamp Rd., Furlong, Pa. 18925

[21] Appl. No.: 627,402

[22] Filed: Jul. 3, 1984

Related U.S. Application Data

[63] Continuation-in-part of Ser. No. 450,181, Dec. 15, 1982, abandoned.

[51] Int. Cl.[4] ..... A61H 1/02

[52] U.S. Cl. ..... 128/25 R; 128/25 B; 272/70

[58] Field of Search ..... 128/25 R; 434/255; 128/25 B; 272/70

[56] References Cited

U.S. PATENT DOCUMENTS

| | | | |
|---|---|---|---|
| 2,332,184 | 10/1943 | Sweeney | 128/25 R |
| 2,598,204 | 5/1952 | Allen . | |
| 2,893,380 | 7/1959 | Walker et al. . | |
| 3,060,926 | 10/1962 | May . | |
| 3,071,130 | 1/1963 | Hoyer et al. | 128/25 R |
| 3,316,898 | 5/1967 | Brown | 128/25 R |
| 3,362,090 | 1/1968 | Adam | 434/255 |
| 3,363,335 | 1/1968 | Burhns et al. | 128/25 R |
| 3,450,132 | 6/1969 | Ragon et al. . | |
| 3,455,295 | 7/1969 | Kellogg | 128/25 R |
| 3,460,272 | 8/1969 | Pellicore | 128/25 R |
| 3,568,666 | 3/1971 | Dunn . | |
| 3,661,149 | 5/1972 | Ferries | 128/25 R |
| 3,824,993 | 7/1974 | Grant . | |
| 3,895,623 | 7/1975 | Mahlandt et al. . | |
| 3,976,058 | 8/1976 | Tidwell | 128/25 R |
| 3,989,240 | 11/1976 | Victor et al. . | |

*Primary Examiner*—Richard J. Apley
*Assistant Examiner*—John L. Welsh
*Attorney, Agent, or Firm*—Z. T. Wobensmith, III

[57] ABSTRACT

An alternative health care machine is disclosed for exercising a patient's arms and legs in which one arm and an opposite leg are alternatively raised and lowered, the apparatus being useful in the treatment of strokes, emotional stress, paraplegics, quadriplegics, motor control problems, slow learners, multiple sclerosis, cerebral palsy, hypertension, for relaxing the diaphragm muscles, for using both sides of the brain at the same time, relaxation, balancing blood pressure, and after a chiropractic adjustment for retaining the adjustment.

9 Claims, 9 Drawing Figures

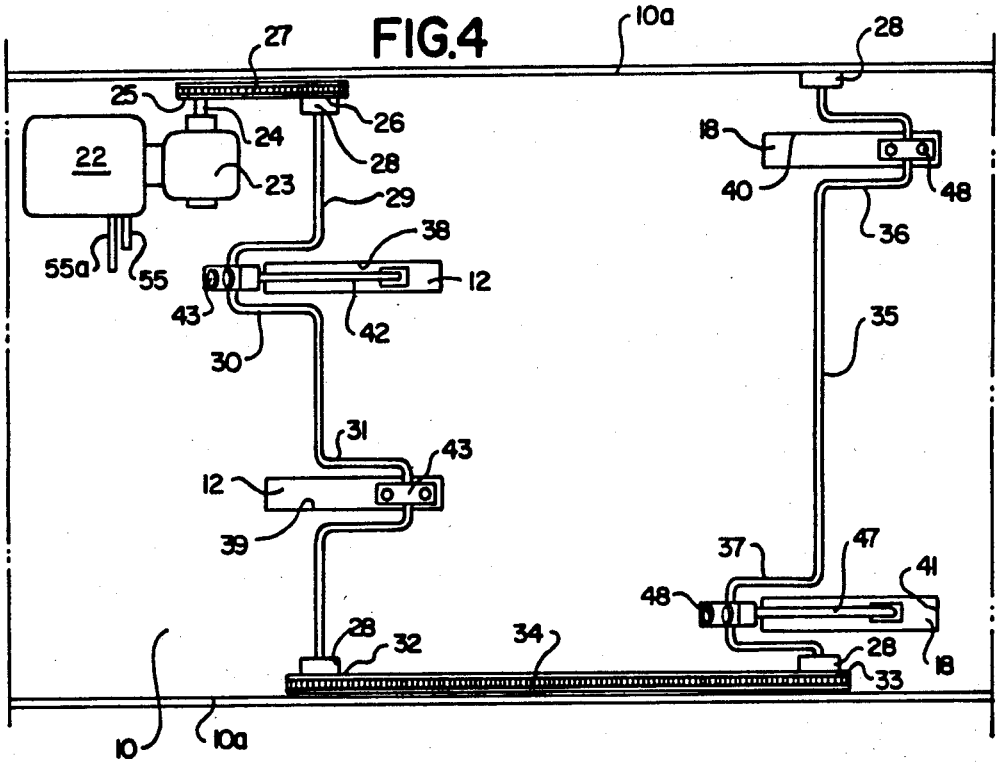
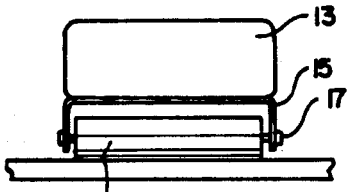
FIG.5
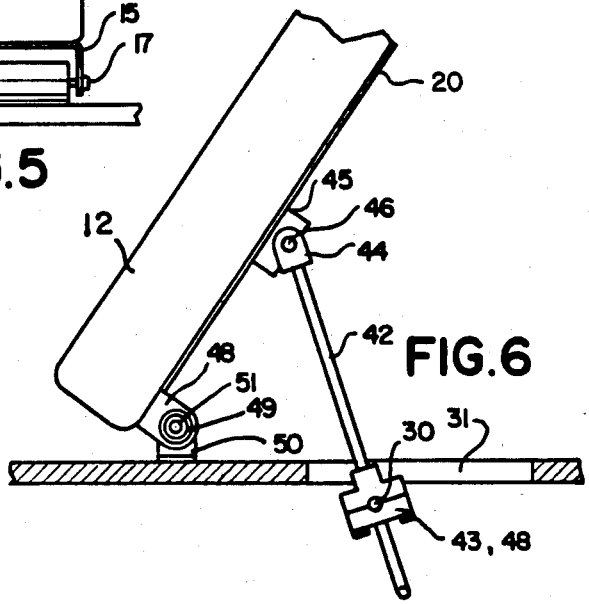
FIG.6

ALTERNATIVE HEALTH CARE MACHINE

CROSS REFERENCE TO RELATED APPLICATIONS

This application is a continuation-in-part of my prior application Ser. No. 450,181, filed Dec. 15, 1982 entitled Exercising Apparatus, now abandoned.

BACKGROUND OF THE INVENTION

1. Field of the Invention

This invention relates to an alternative health care machine of the type onto which a patient is placed in a supine position and which provides for exercising the arms and legs in a synchronized manner.

2. Background of the Prior Art

Various forms of apparatus have heretofore been proposed for exercising the arms and legs of a person.

It is important when exercising the arms and legs of a patient who is suffering from a disability such as a stroke, or other problem, that the arms and legs be exercised in a cross crawl pattern which aids in brain patterning, and also in regaining training the the body to resume its normal functioning as well as providing other benefits.

None of the available apparatus provides the advantages obtained from the use of my invention.

Ragon et al., in U.S. Pat. No. 3,450,132, shows a motor driven exercising apparatus in which two motors are employed, in which the legs are not parallel, in which the movements of the arm and opposite leg are not synchronized, and which has numerous other differences from my invention.

Victor et al., in U.S. Pat. No. 3,989,240, shows an electrically timed exercising device having a frame strap, strap grips, and sequencing control, the various types of exercises available being shown in FIGS. 2A to 2F, inclusive.

May, in U.S. Pat. No. 3,060,926, shows a therapeutic table in which the legs are not required to be parallel, in which the arm is bent at the elbow in a manner different from my invention, and in which there is no synchronized alternating patterning between the right and left sides of the patient.

Allen, in U.S. Pat. No. 2,598,204, shows a hydraulically operated exercising table in which a leaf section is provided so that when the legs are moved above and below the horizontal, the leg muscles stretch, no provision being made for synchronizing alternately the arm and leg movement with bending at the knee and at the elbow.

Mahlandt et al., in U.S. Pat. No. 3,895,623, show a physical therapy machine in which the arms are moved through a predetermined arc shown at 47, while the feet are received in a shoelike support 90 for alternating, causing the legs to bend at the knee.

Walker et al., in U.S. Pat. No. 2,893,380, show a massage and exercising machine in which the mechanism for shoulder treatment comprises two shoulder pads, and for hip treatment comprises two hip pads, with the shoulders and hips loosely supported by the body frame so that considerable massage action results.

Dunn, in U.S. Pat. No. 3,568,666, shows patterning apparatus in which the legs only are exercised in predetermined pattern as shown in FIG. 1, for cross pattern and homolateral forms of treatment.

Grant, in U.S. Pat. No. 3,824,993, discloses a physotherapy method and apparatus for teaching brain damaged children or adults the homolateral gestalt and cross-pattern gestalt which requires the patient to exercise in an upright position, which considerably restricts the usage of the apparatus.

The apparatus of my invention can be used by patients with a large variety of disabilities in a supine position and which provides many advantages over previously available apparatus.

SUMMARY OF THE INVENTION

In accordance with the invention, an alternative health care machine is provided for exercising the arms and legs of a patient in a supine position in which one of the arms is raised and lowered, and an opposite leg is bent at the knee by being alternatively raised and lowered, the apparatus being useful in the treatment of strokes, emotional stress, paraplegics, quadriplegics, motor control problems, slow learners, multiple sclerosis, cerebral palsy, hypertension, for relaxing the diaphragm muscles, for using both sides of the brain at the same time, for relaxation, for balancing blood pressure, and after a chiropractic adjustment for retaining the adjustment.

It is the principal object of the invention to provide an alternative health care machine for synchronized exercising in which one of the arms is bent at the elbow, and an opposite leg is bent at the knee by being alternatively raised and lowered.

It is a further object of the invention to provide an alternative health care machine which provides a wide range of beneficial effects for the patient using the machine.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 4 is an underneath plan view of the machine of FIG. 1;

FIG. 5 is an enlarged end view of one of the leg elevating devices;

FIG. 6 is an enlarged detail as seen from the side of one of the leg elevating devices;

Figure 1:
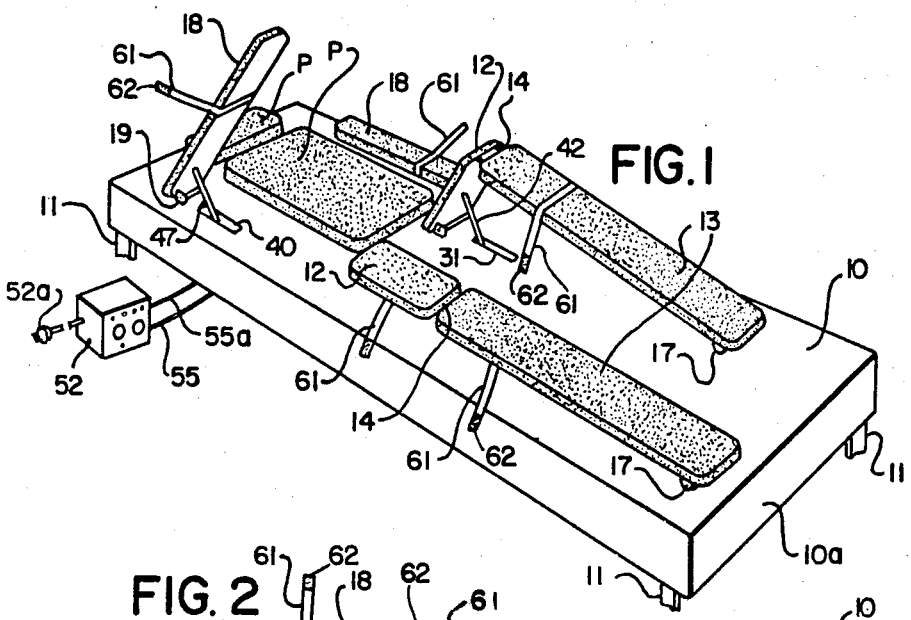
FIG. 1 is a view in perspective of the alternative health care machine in accordance with the invention.
Figure 2:
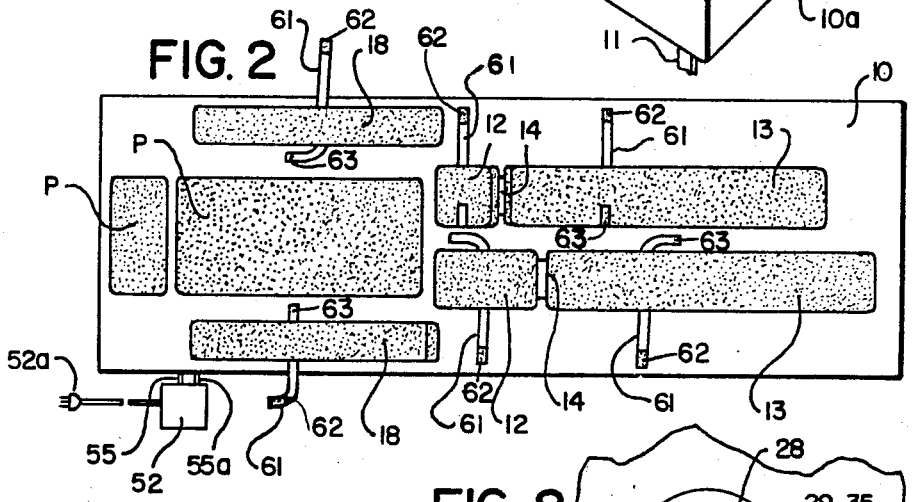
FIG. 2 is a top plan view of the machine of FIG. 1.

It should, of course, be understood that the description and drawings herein are illustrative merely and that various modifications and changes can be made in the structure disclosed without departing from the spirit of the invention.

Like numerals refer to like parts through the several views.

DESCRIPTION OF THE PREFERRED EMBODIMENT

Referring now more particularly to the drawings, the alternative health care machine includes a horizontal table portion 10 with a downwardly extending rim 10*a*, supported by post 11, which may rest on the floor or other surface (not shown).

First leg support members 12 and second leg support members 13 are provided, the leg supports 12 and 13 being hingedly connected together at 14. The leg supports 13 at their lower ends each have a bracket 15 attached thereto and which carries a roller 16 on a shaft 17. Arm supports 18 for the forearm of a patient are provided and connected to the table portion 10 by hinges 19.

The leg supports 12 and 13 include plates 20 of plywood with a cushion of foam thereon (not shown) and which may have an outer covering of Naugahyde or leather thereon (not shown) as desired.

The arm supports 18 can also include plates (not shown) of plywood with a cushion of foam thereon (not shown) and which may have an outer covering of Naugahyde or leather thereon (not shown), as desired.

Pads P can be provided on table portion 10 for engagement by the head and shoulders of the user.

The structure for controlling the positioning of the leg supports 12 and the arm supports 18 is shown in FIG. 4, and includes a variable speed motor 22 connected through a speed reducer 23 to a shaft 24. The shaft 24 has a sprocket 25 carried thereon which is connected to a sprocket 26 by a chain 27.

A crank shaft 29 is provided to which the sprocket 26 is fixed and which has a crank 30 and a crank 31 for purposes to be explained. The crank shaft 29 has a sprocket 32 hereon which is connected to a sprocket 33 by a chain 34. The sprocket 33 is fixed to a crank shaft 35 which has a crank 36 and a crank 37.

Figure 8:
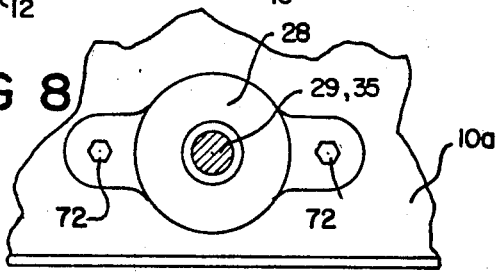
FIG. 8 shows a plastic insert employed in FIG. 7.

The crank shafts 29 and 35 at their ends are mounted in self-aligning spherical bearings 28, which are bolted to the rim 10*a* of the table 10 by bolts 72 (see FIG. 8).

Spaced slots 38, 39, 40 and 41 are provided through the table portion 10.

The cranks 30 and 31 have connecting rods 42 connected thereto and which extend through the slots 38 and 39, the rods 42 being connected by detachable connectors 43 which are pivotally connected to the leg supports 12 by pivot brackets 44 connected to brackets 45 by pins 46.

The cranks 36 and 37 have connecting rods 47 connected thereto, and which extend through the slots 40 and 41, the rods 47 being connected by detachable connectors 48 which are pivotally connected to the arm spports 18.

The effective length of the rods 42 and 47 between the cranks 30, 31, 36 and 37 and the supports 12, 13 and 18 can be varied to change the lift height of the supports as desired.

Figure 7:
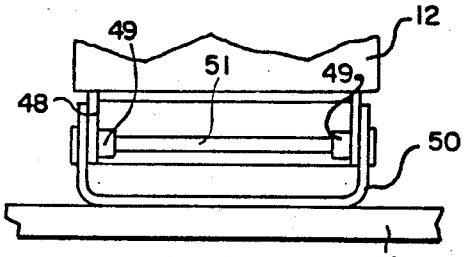
FIG. 7 is a view in elevation as seen from the front, of the hinging of one of the leg elevating devices.

Referring now to FIGS. 6 and 7, the hinging of one of the leg supports 12 is there illustrated, and includes a bracket 50 carried on the upper face of the table portion 10, with a bracket 48 carried on the plate 20 of the leg support 12. Insertable bushings 49 of nylon or the like are provided in frictional engagement with the bracket 48, and with a bracket 50, with a pin 51 pivotally connecting the brackets 48 and 50 together.

Figure 3:
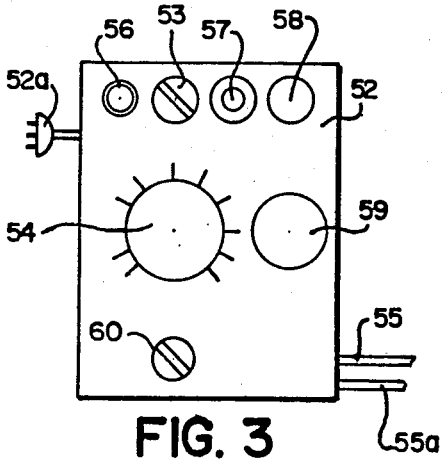
FIG. 3 is an enlarged view of the control apparatus for the machine of FIG. 1.
Figure 9:
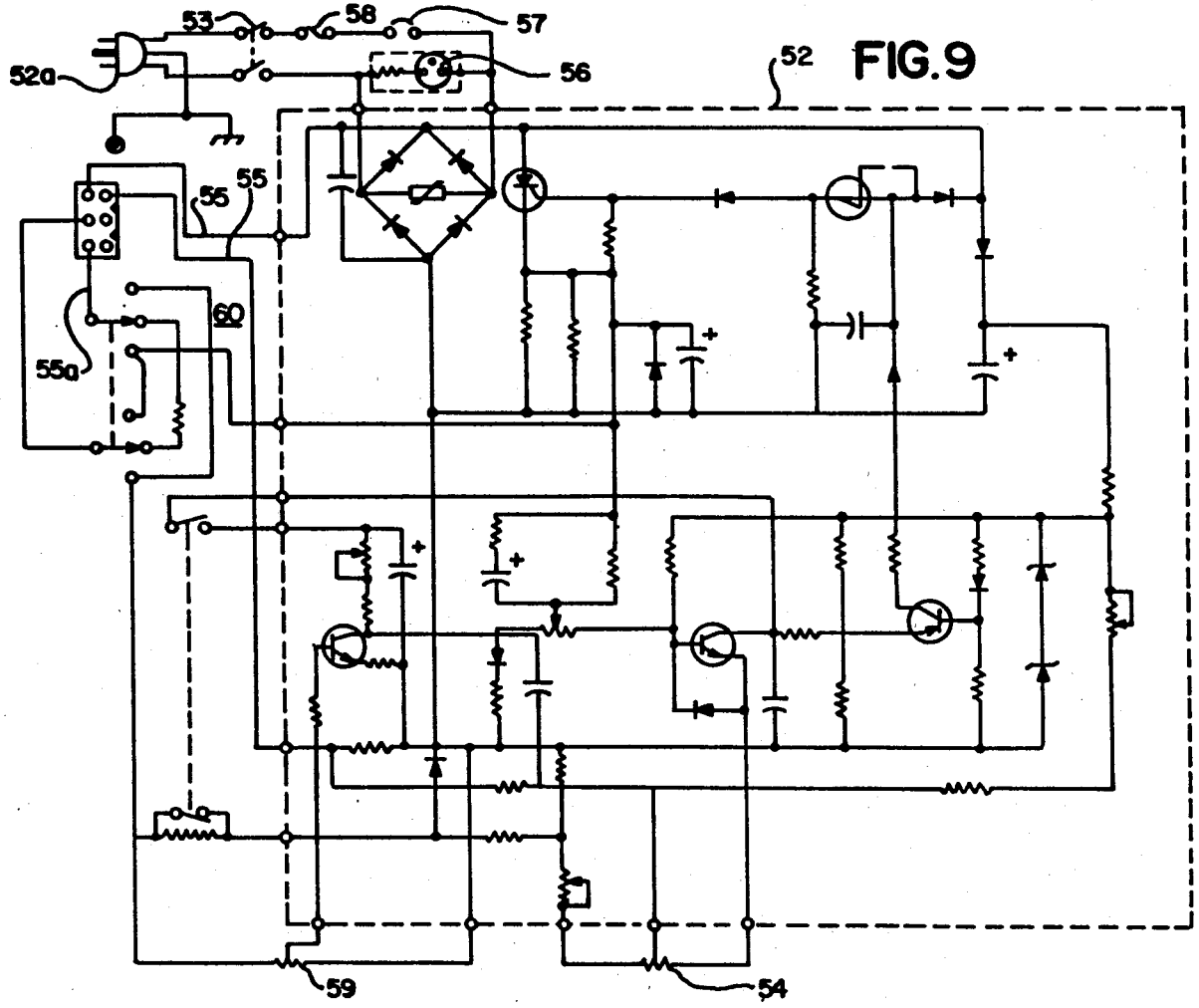
FIG. 9 shows the wiring diagram for the control apparatus.

A control apparatus 52 for controlling the speed of the motor 22 is provided which is illustrated in FIGS. 3 and 9, which has an energizing plug 52*a*, a toggle switch 53 and a rotatable speed control 54. A conductor 55 is provided to connect the controller 52 to the field of the motor 22 and a conductor 55*a* connects the control apparatus 52 to the armature of the motor 22. The details of the control apparatus 52 are shown in U.S. Pat No. 3,457,672.

The control apparatus 52 also has a pilot light 56, which is illuminated when the toggle switch 53 is in the "on" position. The control apparatus 52 also includes a reset button 57, a fuse 58, a torque limit control 59, and a movable control 60 for "forward", "brake", and "reverse" operation.

Elastic straps 61 may be employed which are attached to the arm supports 18 and the leg supports 12 and 13 for retaining the arms and legs of a patient (not shown) in engagement with the arm supports 18 and the leg supports 12 and 13 for exercise. The straps 61 may be provided with strips of velcro 62 and 63 for ease of engagement and disengagement.

The mode of operation will now be described.

A patient (not shown) who is to undergo treatment is placed on the pads in a supine position with his or her arms or legs placed on the arm supports 18 and the leg supports 12 and 13. The straps 61 are placed over the patient's arms and legs and secured.

The toggle switch 53 is moved to the "on" position to supply electrical energy to the motor 22, through the conductors 55 and 55*a*, and which energizes the light 56. The rotatable speed control 54 is then adjusted to the desired speed of operation. The torque control 59, and the movable control 60 will not normally require attention.

The motor 22, through the speed reducer 23, shaft 24, sprocket 25, chain 27, and sprocket 26 will operate the crank shaft 29 carried in the bearings 28, to move the cranks 29 and 31 and the connecting rods 42. The connecting rods 42 will alternately raise and lower the arm supports 18 on each side, thereby raising and lowering the arms of the patient (not shown) who is undergoing treatment.

The crank shaft 35 is rotated by the chain 34 which is in engagement with sprockets 32 and 33, and through the cranks 36 and 37, the connecting rods 47 alternately raise and lower the leg supports 12, the leg supports 12 by hinged connections 14 to the leg support 13, also raises and lower the leg supports 13 in an alternating relation.

It should be noted that the machine has several safety operating features which includes: (1) preset torque; the torque limiting preset on the permanent magnet D.C. motor is for safety. Should a patient's leg or arm get under the moving parts of the machine [the patient's arms and legs moving up and down for exercise] motor will stall causing the machine to stop, thus preventing injury. When the obstacle is removed, the reset button 57 is pushed and the machine will go back to normal operation; (2) a neutral safety switch: machine can not accidently be turned on. The switch must be manually put in forward or reverse position, then the start button pressed before the machine will operate; (3) an amber light indicator verifying power to control box, which indicates that there is electricity to the control apparatus; (4) a forward and reverse switch which is necessary as a safety feature. If an object gets lodged under any of the moving parts, the machine will automatically stop, then the movable control 60 can be moved to make moving parts move back so that the lodged object can be removed; and (5) a variable speed control which allows the machine to go from approximately 15 steps per minute to a normal walking speed. The speed being determined by the patient's problem that is to be helped.

Several machines in accordance with the invention have been placed in various locations for some months and their usage has been found helpful in improving the condition of patients who suffer from problems associated with strokes, speech disabilities, vascular flow, brain patterning, muscular distress, and many other problems associated with injury or disease where synchronized exercise of the arms and legs in a normal exercise pattern simulating normal movements of walking is useful.

It will thus be seen that a machine has been provided with which the objects of the invention are achieved.

I claim:

1. An alternative health care machine for synchronized exercising of the opposite arms and legs of a patient who is in a supine poition, the machine including a table on which the patient rests, the table having a pair of first leg support members hingedly connected to a pair of second support members;

said pairs of first and second leg support members being in parallel relation and engaging the legs of said patient;

a pair arm support members engaging the forearms of said patient;

means for alternatively raising and lowering said arm support members and said leg support members, whereby said opposite arms and legs are exercised together in a cross crawl pattern; and said means is motor driven and has torque limiting means.

2. An alternative health care machine as defined in claim 1 in which said motor driven means is adjustable as to speed.

3. An alternative health care machine as defined in claim 1 in which said second leg support members have rotatable support therefor.

4. An alternative health care machine as defined in claim 1 in which insertable bushings are provided for said first leg support members.

5. An alternative health care machine as defined in claim 4 in which said bushings are of synthetic plastic.

6. An alternative health care machine as defined in claim 4 in which said bushings are of nylon.

7. An alternative health care machine as defined in claim 1 in which said motor driven means includes an electric motor, an output shaft on said motor, and crank means connected to said output shaft, to said arm supports and to said first leg supports for alternatively raising each of said leg supports and each of said arm supports in synchronized relation.

8. An alternative health care machine as as defined in claim 1 in which cushions are provided on said arm supports and said leg supports between said supports and the arms and legs of the patient.

9. An alternative health care machine as as defined in claim 1 in which said arm support movement can be varied.

* * * * *